US007600570B2

(12) United States Patent
Haughom

(10) Patent No.: US 7,600,570 B2
(45) Date of Patent: Oct. 13, 2009

(54) DRILLING RIG PLACED ON THE SEA BED AND EQUIPPED FOR DRILLING OF OIL AND GAS WELLS

(75) Inventor: Per Olav Haughom, Tonstad (NO)

(73) Assignee: Seabed Rig AS (NO)

( * ) Notice: Subject to any disclaimer, the term of this patent is extended or adjusted under 35 U.S.C. 154(b) by 53 days.

(21) Appl. No.: 11/734,599

(22) Filed: Apr. 12, 2007

(65) Prior Publication Data

US 2007/0196180 A1 Aug. 23, 2007

Related U.S. Application Data

(63) Continuation of application No. PCT/NO2006/000234, filed on Jun. 21, 2006.

(30) Foreign Application Priority Data

Jul. 5, 2005 (NO) ..... 20053279

(51) Int. Cl.
*E21B 7/12* (2006.01)

(52) U.S. Cl. ..... 166/358; 166/356; 175/6; 175/52; 175/85

(58) Field of Classification Search ..... 175/5–10, 175/52, 85; 166/358
See application file for complete search history.

(56) References Cited

U.S. PATENT DOCUMENTS 2,781,185 A * 2/1957 Robbins ..... 175/52
2,972,388 A * 2/1961 Thornburg ..... 175/52
3,294,185 A * 12/1966 O'Neill et al. ..... 175/85
3,353,364 A * 11/1967 Blanding et al. ..... 405/189
3,493,061 A * 2/1970 Gyongyosi ..... 175/52
3,552,504 A * 1/1971 Chappuis ..... 175/52
3,661,204 A * 5/1972 Blanding et al. ..... 166/356
3,670,830 A 6/1972 Van Der Wijden
3,741,320 A * 6/1973 Hilfing ..... 175/6
3,977,480 A * 8/1976 Hilding ..... 175/85
4,043,407 A * 8/1977 Wilkins ..... 175/50
4,165,690 A * 8/1979 Abrahams ..... 102/314
4,255,068 A * 3/1981 Valantin ..... 405/195.1
4,442,900 A * 4/1984 Padilla et al. ..... 166/342
5,174,389 A * 12/1992 Hansen ..... 175/52
6,095,259 A * 8/2000 Keyes ..... 175/20
6,138,774 A * 10/2000 Bourgoyne et al. ..... 175/7
6,394,192 B1 * 5/2002 Frazer ..... 175/58

(Continued)

FOREIGN PATENT DOCUMENTS

DE 2056064 B * 2/1977

(Continued)

*Primary Examiner*—Thomas A Beach
(74) *Attorney, Agent, or Firm*—Akerman Senterfitt

(57) ABSTRACT

A drilling placed on the seabed and arranged for drilling of oil and gas wells is remote controlled from a light drilling vessel (2) through pipes and signal cables (3). The main structure of the drilling rig is made up of two cylindrical structures (1 and 10), in connection with which there is provided a number of cylindrical silos (8) for storing drill pipe magazines (23). A complete drilling module (17) can be lowered and retrieved through hatchways (11) at the top of the first cylindrical structure 10 The drilling rig is anchored to a foundation frame (7) by hydraulic legs (9). A cylindrical skirt (34) encloses the BOP (33) to prevent pollution of the environment.

3 Claims, 5 Drawing Sheets

U.S. PATENT DOCUMENTS

| | | | | |
|---|---|---|---|---|
| 6,397,955 | B1 * | 6/2002 | Cour | 175/52 |
| 6,457,526 | B1 * | 10/2002 | Dailey | 166/338 |
| 6,543,551 | B1 * | 4/2003 | Sparks et al. | 175/52 |
| 6,659,180 | B2 * | 12/2003 | Moss | 166/339 |
| 6,763,889 | B2 * | 7/2004 | Rytlewski et al. | 166/338 |
| 7,380,614 | B1 * | 6/2008 | Williamson et al. | 175/6 |
| 2001/0020550 | A1 * | 9/2001 | Casagrande | 175/52 |
| 2003/0106714 | A1 * | 6/2003 | Smith et al. | 175/6 |
| 2005/0109537 | A1 * | 5/2005 | Ayling | 175/5 |
| 2008/0093082 | A1 * | 4/2008 | Sheshtawy | 166/368 |

FOREIGN PATENT DOCUMENTS

| | | | |
|---|---|---|---|
| GB | 1580790 | A | 12/1980 |
| GB | 2 094 852 | | 9/1982 |
| NO | 315952 | | 11/2003 |
| WO | WO 86/01556 | | 3/1986 |
| WO | WO 03/093625 | | 11/2003 |
| WO | WO 03/093625 | A2 * | 11/2003 |
| WO | WO 2004/018826 | | 3/2004 |
| WO | WO 2004018826 | A1 * | 3/2004 |
| WO | WO 2007129899 | A1 * | 11/2007 |
| WO | WO 2008100149 | * | 8/2008 |
| WO | WO 2008130242 | * | 10/2008 |

* cited by examiner

DRILLING RIG PLACED ON THE SEA BED AND EQUIPPED FOR DRILLING OF OIL AND GAS WELLS

This invention regards a drilling rig of the type used for drilling oil and gas wells. More particularly, it regards a drilling rig placed on the seabed and arranged for drilling of oil and gas wells, the drilling rig being equipped with a drilling module and at least one drill pipe magazine. A watertight cylindrical main structure comprising concentric cylindrical structures is provided with a plurality of silos for storing drill pipes, the upper portions of the cylindrical structures and the silos being provided with corresponding sealing hatchways for passing equipment in and out.

Oil and gas deposits in the earth's crust are exploited by drilling a hole down to the deposit to allow oil and gas to drain to the surface.

The equipment used for drilling holes in the ground consists chiefly of a drilling derrick designed as a trussed steel structure. In the derrick there is hoisting machinery with a wire for hoisting and lowering drill pipes. There is also various equipment for handling the drill pipes and running casings into the borehole.

Oil and gas deposits in deep waters are exploited by using floating or fixed platforms equipped with drilling equipment. These platforms end up as large and costly structures because the drilling equipment is bulky and heavy. Besides the actual drilling equipment, there must also be provided a riser connection between the platform and the seabed in order to circulate drilling mud during drilling. Floating platforms must also be provided with heave compensators to accommodate the wave motion of the platform relative to the seabed. Often, the drilling operations must be interrupted during extreme weather conditions, which involve hazardous operations and high costs. Operations that must be carried out under difficult weather conditions and high wave loading also involves great risks.

A common drawback of known methods of drilling at great ocean depths is the fact that they require the use of expensive floating platforms at high daily rates.

These problems form the basis of the present invention, the general object of which has been to provide a drilling rig, which can be placed on the seabed to perform drilling operations without the use of floating drilling platforms.

An alternative to drilling from floating drilling platforms is to place the drilling rig directly on the seabed, thus eliminating the need for large and expensive platforms, Today's oil industry has developed a great deal of advanced equipment for remote controlled subsea operations. This technology is available and can be used in a remote controlled operation where the drilling equipment is placed directly on the seabed.

Having the drilling rig located on the seabed will reduce the surface vessel requirements, making it possible to use a smaller ship with a limited lifting capacity.

Thus WO 2004/018826 describes a drilling rig arranged on the seabed, where pipe cartridges are supplied to the drilling rig from a surface vessel. The device of the WO publication consists of an open structure that makes it difficult to change out any other equipment than the pipe cartridges.

The object of the invention is to remedy or reduce at least one of the drawbacks of prior art.

The object is achieved in accordance with the invention, by the features given in the description below and in the following claims.

A drilling rig placed on the seabed and arranged to drill oil and gas wells is, in accordance with the invention, provided with a drilling module and at least one drill pipe magazine, and is characterized by a watertight cylindrical main structure comprising concentric cylindrical structures, and which is provided with a plurality of silos for storing drill pipes, the upper portions of the cylindrical structures and the silos being provided with corresponding sealing hatchways for passing equipment in and out.

The drilling module is designed as a separate module with, among other things, a drilling machine and drill pipe handling equipment arranged centrally within the cylindrical main structure. The drilling module can be passed into the main structure through transfer openings in the top. The drilling module comprises a main structure provided with hoisting cylinders, and also a drilling machine and a pipe-handling robot equipped with hoisting and gripping devices. The drilling module can be displaced through the hatchway associated with a first cylindrical structure.

Drill pipes are also passed in through hatches in the upper portions of the silos, while other equipment is passed in through openings in a second cylindrical structure.

A blowout preventer (BOP) is arranged on a foundation frame on the seabed. The lower part of the drilling rig is provided with a cylindrical skirt arranged to engage a corresponding cylindrical structure on the foundation frame, thereby encapsulating the BOP.

The drilling rig is anchored to the seabed through the pre-lowered foundation frame or directly to the seabed, e.g. by means of suction anchors. A plurality of hydraulic legs on the drilling rig anchors the drilling rig to the foundation frame located on the seabed.

Between the ship and the drilling rig there are flexible cables and hoses provided for control and monitoring of the drilling rig operations. As mentioned, the entire rig is encased, preventing discharges to the surrounding environment. Drill pipes and other equipment are transported down to modules and passed into the drill rig through hatchways.

The operation of the drilling rig functions is carried out by remote control and through the use of known remote operated vehicles, so-called ROVs.

Advantageously the drilling rig is provided with buoyant elements to facilitate the submersion operation during the seabed installation procedure.

Moreover, the drilling rig is arranged to carry out maintenance operations on wells and any work required in connection with plugging of wells to be abandoned.

The following describes a non-limiting example of a preferred embodiment illustrated in the accompanying drawings, in which.

Figure 1:
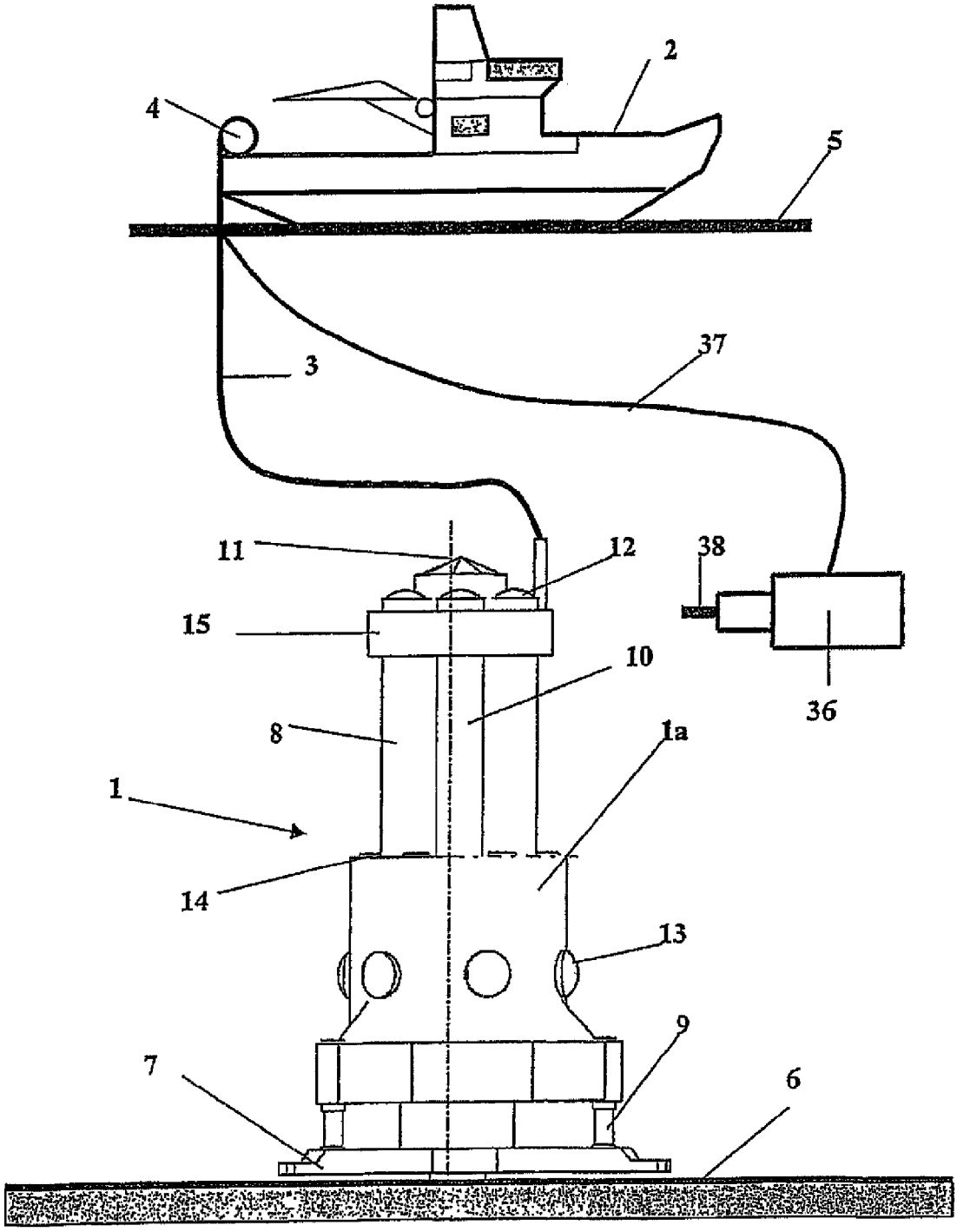
FIG. 1 shows a drilling rig placed on the seabed, connected to a surface vessel by flexible cables and hoses.

In the drawings, reference number 2 denotes a light surface vessel on the surface of the sea 5, with hoisting equipment 4 installed. Flexible pipes and control cables 3 extend between the vessel 2 and a drilling rig 1 placed on the seabed 6.

The main structure of the drilling rig 1 comprises a first cylindrical structure 10 and a second cylindrical structure 1*a*, which is concentric to the first cylindrical structure 10, where a number of cylindrical silos 8 are arranged to encircle the first cylindrical structure 10, for passing drill pipe magazines 23 in through hatchways 12 in the upper portions of the silos 8.

The lower portion of the second cylindrical structure 1*a* is provided with hydraulic support legs 9 that engage a foundation frame 7.

Around the surface shell of the second cylindrical structure 1*a* there is provided hatchways 13 for servicing and maintaining equipment (not shown) by use of an ROV 36 with gripping devices 18, remote controlled via a cable 37.

Figure 5:
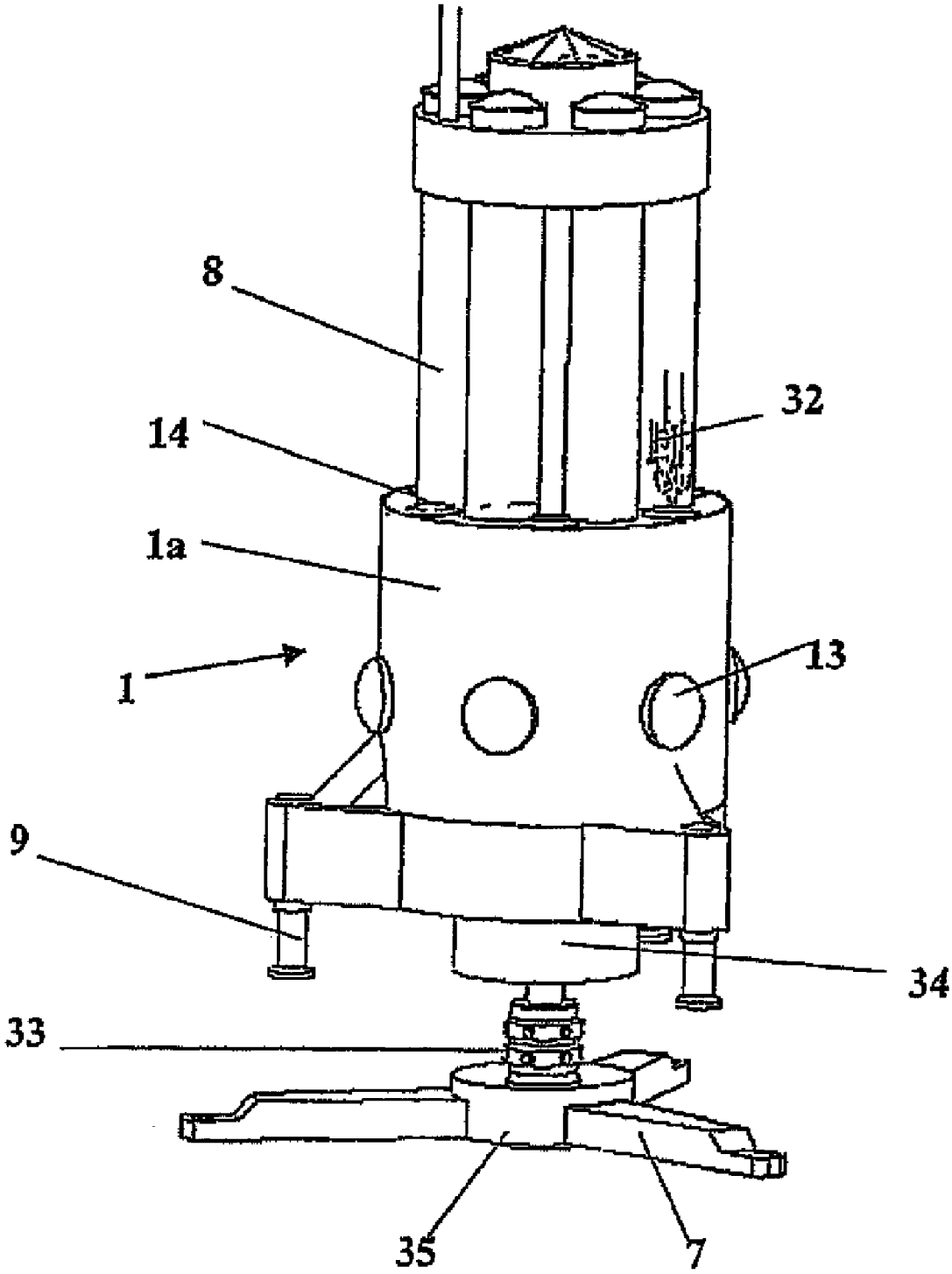
FIG. 5 shows the drilling rig about to be placed on the seabed, against a foundation frame to which there has been fitted a BOP.

Hatchways 14 are provided by the upper portion of the second cylindrical structure 1*a*, which hatches are used for transfer of mud pumps 32, see FIG. 5, and other auxiliary equipment.

The drilling rig 1 is provided with a buoyancy element 15 for weight compensation.

Figure 2:
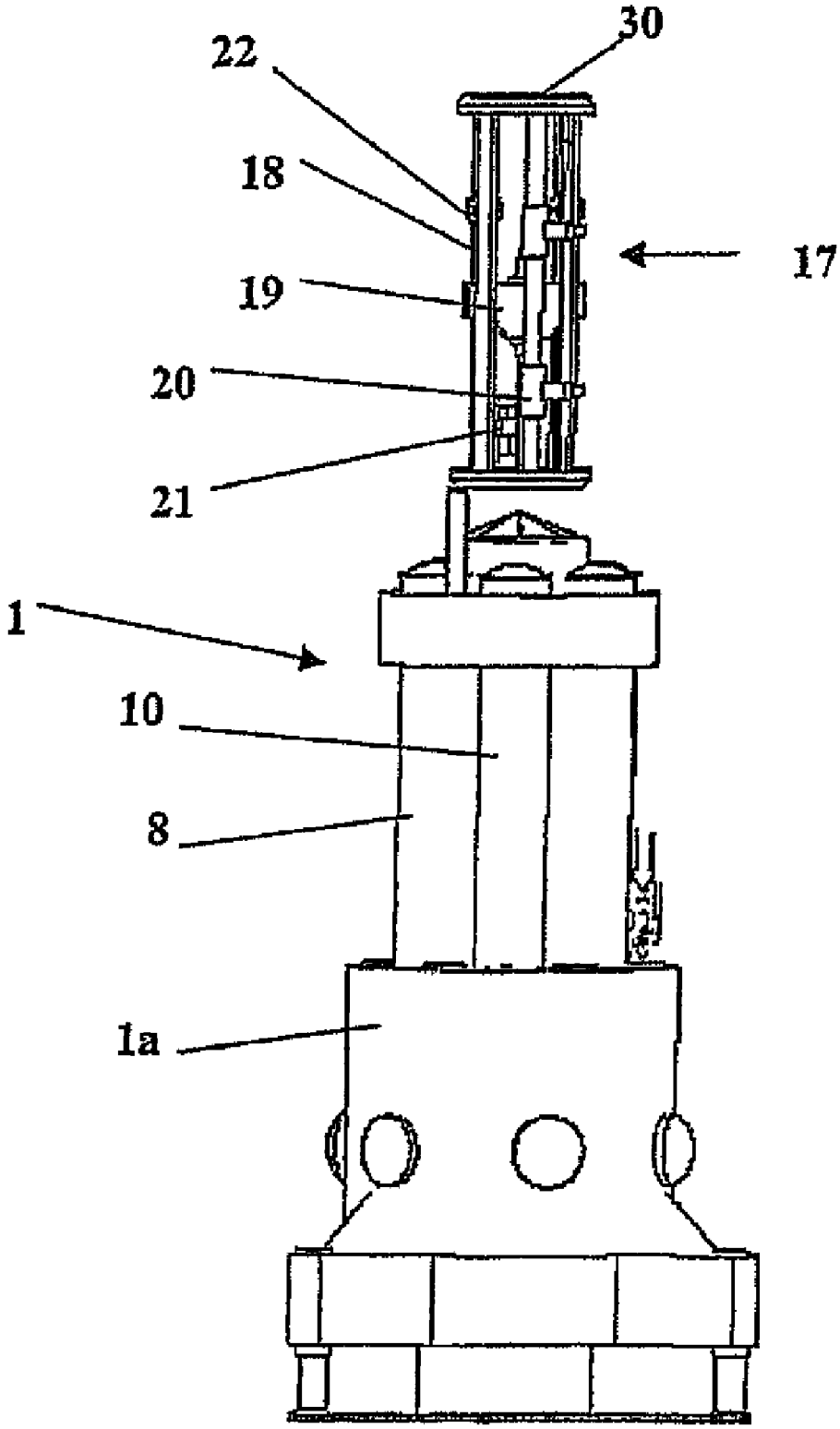
FIG. 2 shows the drilling module ready to be passed into the main structure through hatchways.
Figure 3:
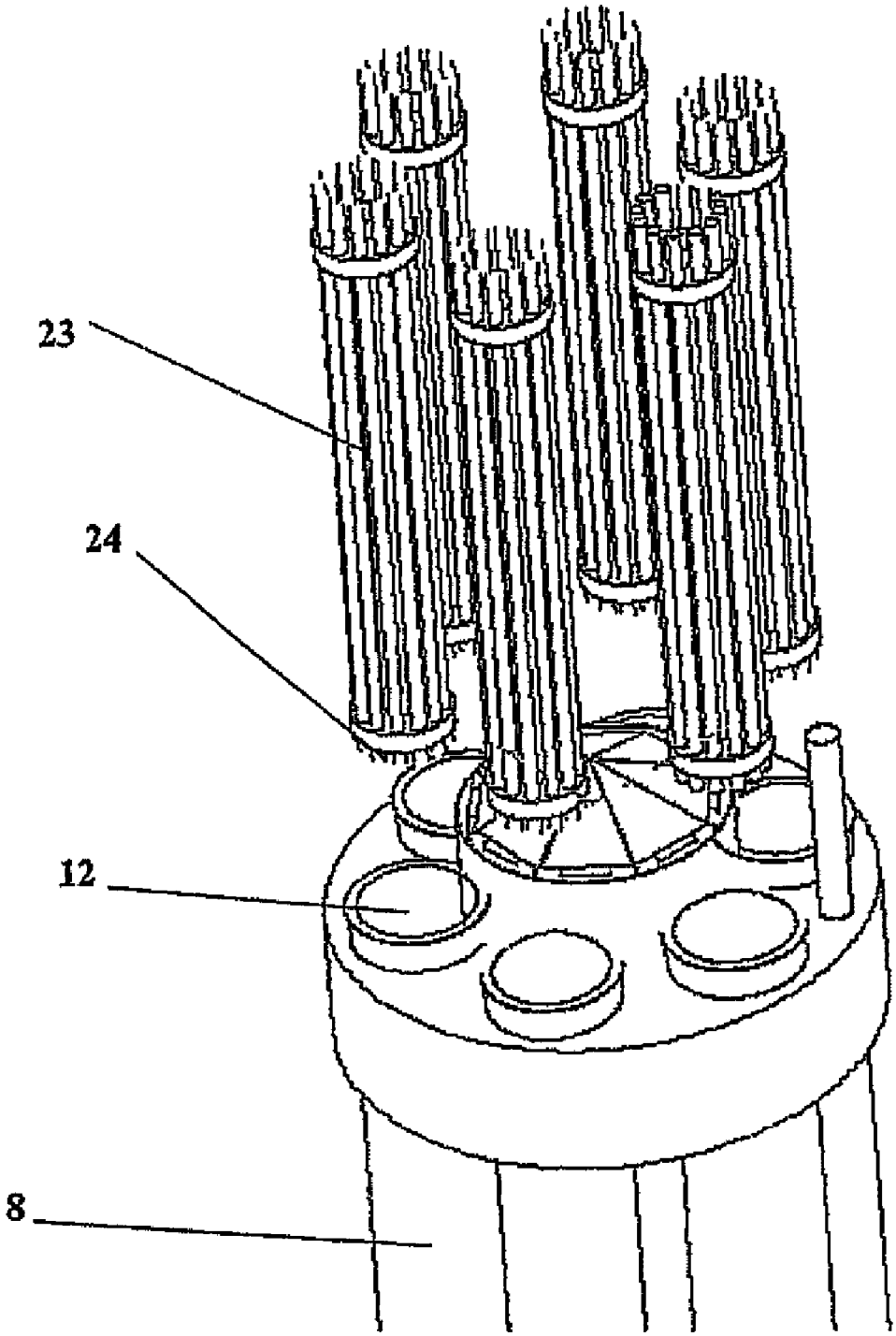
FIG. 3 is a larger scale view of drill pipes ready to be passed in through hatchways.
Figure 4:
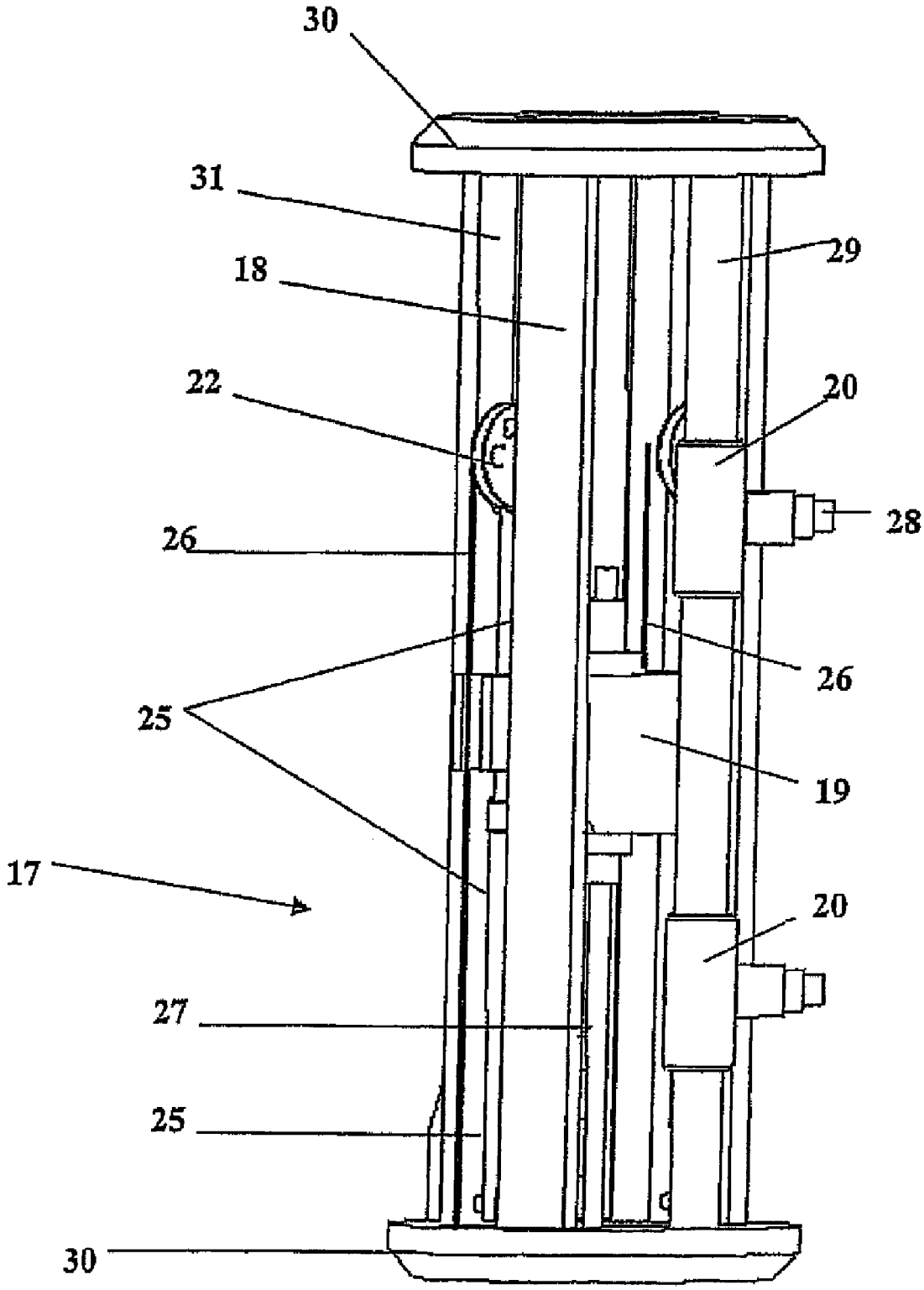
FIG. 4 shows the drilling module on a larger scale.

A complete drilling module 17, see FIGS. 2 and 3, may be lowered and raised centrically through hatchways 11 in the upper portion of the first cylindrical structure 10.

The drilling module 17 is equipped with all the equipment required for drilling operations.

In this preferred embodiment the drilling module 17 comprises a main structure 18 for which there are provided circular end pieces 30, allowing the entire drilling module to rotate about its longitudinal axis. Elongated slots 31 are provided in the main structure 18, serving as guides for the drilling machine 19 associated with a drill pipe 27.

The drilling machine 19 is hoisted and lowered by hydraulic cylinders 25.

At the top of the piston rod of the cylinder 25 there are pulleys 22. A wire 26 runs across these pulleys 22, so that one end of the wire 26 is attached to the end piece 30 and the other end is attached to the drilling machine 19. This construction gives a hoisting length, which is twice the length of stroke of the cylinder 25.

The drilling module 17 is provided with a pipe handling robot for handling drill pipes 27, which robot comprises a vertical column 29 attached to the end pieces 30 and gripping and hoisting devices 28, 26 that run along the cylindrical column, which devices may be displaced vertically and rotated about the vertical axis of the column in order to handle drill pipes 27 between the centre of the borehole and storage spaces in the silo 8.

The drill pipe magazines 23 with cylindrical fasteners 24, see FIG. 3, are lowered into the pipe silos 8 through hatchways 12 in the upper portions of the pipe silos 8.

The lower part of the second cylindrical structure 1*a* is provided with a cylindrical skirt 34, see FIG. 5, which engages a complementary cylindrical part 35 on the foundation frame 7, whereby a BOP 33 is enclosed to prevent pollution of the environment.

The invention claimed is:

1. A drilling rig placed on the seabed and arranged for drilling of oil and gas wells, wherein the drilling rig comprises:

a drilling module comprising a main structure with hoisting cylinders, a drilling machine, and a pipe handling robot equipped with hoisting and gripping devices;

at least one drill pipe magazine;

a watertight cylindrical main structure comprising first and second concentric cylindrical structures, the cylindrical main structure having a plurality of silos for storing drill pipes in the drill pipe magazines, wherein upper portions of the first and second cylindrical structures and the silos are provided with corresponding sealing hatchways for passing equipment and drill pipe magazines in and out, and wherein the drilling module is displaceable through the hatchway associated with the first concentric cylindrical structure for drilling into the seabed.

2. A drilling rig in accordance with claim 1, wherein the drilling rig is anchored to a foundation frame located on the seabed by a plurality of hydraulic legs.

3. A drilling rig in accordance with claim 1, wherein the silos are positioned between the first and second concentric cylindrical structures and encircle the first concentric cylindrical structure.

* * * * *